US010815811B2

(12) United States Patent
Seshadri et al.

(10) Patent No.: US 10,815,811 B2
(45) Date of Patent: Oct. 27, 2020

(54) ROTATABLE COMPONENT FOR TURBOMACHINES, INCLUDING A NON-AXISYMMETRIC OVERHANGING PORTION

(71) Applicant: GENERAL ELECTRIC COMPANY, Schenectady, NY (US)

(72) Inventors: Ganesh Seshadri, Bangalore (IN); Mahendran Manoharan, Bangalore (IN)

(73) Assignee: General Electric Company, Schenectady, NY (US)

( * ) Notice: Subject to any disclaimer, the term of this patent is extended or adjusted under 35 U.S.C. 154(b) by 108 days.

(21) Appl. No.: 15/824,151

(22) Filed: Nov. 28, 2017

(65) Prior Publication Data

US 2019/0162074 A1 May 30, 2019

(51) Int. Cl.

| | |
|---|---|
| ***F01D 11/12*** | (2006.01) |
| ***F04D 29/16*** | (2006.01) |
| ***F04D 29/32*** | (2006.01) |
| ***F01D 5/22*** | (2006.01) |
| ***F01D 11/08*** | (2006.01) |
| ***F04D 29/52*** | (2006.01) |

(52) U.S. Cl.

CPC ..... *F01D 11/122* (2013.01); *F01D 5/225* (2013.01); *F01D 11/08* (2013.01); *F04D 29/164* (2013.01); *F04D 29/324* (2013.01); *F04D 29/526* (2013.01); *F05D 2240/10* (2013.01); *F05D 2240/20* (2013.01); *F05D 2240/307* (2013.01); *F05D 2240/80* (2013.01); *F05D 2250/71* (2013.01)

(58) Field of Classification Search

CPC . F01D 5/143; F01D 5/22; F01D 5/225; F01D 11/001; F01D 11/08; F01D 11/12; F01D 11/122; F04D 29/16; F04D 29/161; F04D 29/164; F05D 2240/10; F05D 2240/20; F05D 2240/307; F05D 2240/80

See application file for complete search history.

(56) References Cited

U.S. PATENT DOCUMENTS

| | | |
|---|---|---|
| 2,970,808 A | 2/1961 | Coppa |
| 3,455,268 A | 7/1969 | Gordon |

(Continued)

*Primary Examiner* — David E Sosnowski
*Assistant Examiner* — Alexander A White
(74) *Attorney, Agent, or Firm* — McGarry Bair PC

(57) ABSTRACT

A rotatable component for a turbomachine and a method for regulating a circumferential ingress of a fluid at a trailing edge of the rotatable component are disclosed. The rotatable component includes an airfoil and a mechanical component. The airfoil includes a pressure side and a suction side. The mechanical component is coupled to the airfoil and includes a forward overhanging portion, and an aft overhanging portion. The forward overhanging portion is disposed at a leading edge of the airfoil and extends longitudinally beyond the leading edge. The aft overhanging portion is disposed at a trailing edge of the airfoil and extends longitudinally beyond the trailing edge, where both the forward and aft overhanging portions further extend circumferentially along the pressure side and the suction side of the airfoil. The aft overhanging portion includes a non-axisymmetric profile for regulating the circumferential ingress of the fluid from the pressure to suction sides.

20 Claims, 6 Drawing Sheets

(56) References Cited

U.S. PATENT DOCUMENTS

| | | | | |
|---|---|---|---|---|
| 4,534,701 | A | 8/1985 | Wisser | |
| 5,174,714 | A | 12/1992 | Plemmons et al. | |
| 5,177,957 | A | 1/1993 | Grieb | |
| 5,234,318 | A | 8/1993 | Brandon | |
| 5,553,999 | A | 9/1996 | Proctor et al. | |
| 5,562,408 | A | 10/1996 | Proctor et al. | |
| 7,762,779 | B2 | 7/2010 | Zemitis et al. | |
| 2009/0202355 | A1 | 8/2009 | Dierksmeier et al. | |
| 2013/0156563 | A1* | 6/2013 | Mahle | F01D 11/08 415/191 |
| 2013/0272888 | A1* | 10/2013 | Chouhan | F01D 5/225 416/223 R |
| 2014/0140822 | A1 | 5/2014 | Capozzi et al. | |

* cited by examiner

ROTATABLE COMPONENT FOR TURBOMACHINES, INCLUDING A NON-AXISYMMETRIC OVERHANGING PORTION

BACKGROUND

Embodiments of the present invention relate to turbomachines, and more specifically to a rotatable component for the turbomachines, including a mechanical component having a non-axisymmetric overhanging portion.

In turbomachines, for example, a gas turbine engine, air is pressurized in a compressor and subsequently mixed with fuel and combusted in a combustor to generate combustion gases. A turbine disposed downstream relative to the combustor, extracts energy from the combustion gases and drive at least one of the compressor, a fan, a propeller, and any other mechanical load. Generally, the turbine or the compressor includes a rotatable component including an array of airfoils. During operation of the turbomachine, at least a portion of the combustion gases or the compressed air leaks axially along a tip or a root of each airfoil, resulting in undesirable pressure losses, and thereby affecting aerodynamic performance of the turbomachine. Therefore, each airfoil may include a shroud or a platform to regulate an axial leakage flow of the compressed fluid or the combustion gases along the tip or the root, thus reducing the pressure losses, and thereby improving the aerodynamic performance of the turbomachine. However, a pressure difference at a trailing edge between a pressure side and a suction side of each airfoil may cause a periodic ingress of the combustion gases or the compressed air along a circumferential direction from the pressure side to the suction side via a tip shroud cavity or a root platform cavity. The periodic ingress of the fluid results in either increased or decreased mixing of the compressed fluid or the combustion gases with the axial leakage flow, thus causing further undesirable pressure losses, and thereby affecting the aerodynamic performance of the turbomachine.

Accordingly, there is a need for a rotatable component having an enhanced shroud or platform and an associated method for regulating an ingress of fluid, using the mechanical component.

BRIEF DESCRIPTION

In accordance with one embodiment, a rotatable component for a turbomachine is disclosed. In accordance with aspects of the disclosed technique, the rotatable component includes an airfoil and a mechanical component coupled to the airfoil. The airfoil includes a pressure side and a suction side. The mechanical component includes a forward overhanging portion and an aft overhanging portion. The forward overhanging portion is disposed at a leading edge of the airfoil and extends longitudinally beyond the leading edge. The aft overhanging portion is disposed at a trailing edge of the airfoil and extends longitudinally beyond the trailing edge, where both the forward and aft overhanging portions further extend circumferentially along the pressure side and the suction side of the airfoil. The aft overhanging portion includes a non-axisymmetric profile for regulating ingress of a fluid along a circumferential direction from the pressure side to the suction side, at the trailing edge.

In accordance with another embodiment, a turbomachine is disclosed. The turbomachine includes a stationary component and a rotatable component. The stationary component includes an inlet recess portion and abradable seal portions. The rotatable component is disposed within the stationary component. The rotatable component includes an airfoil and a mechanical component coupled to the airfoil. The airfoil includes a pressure side and a suction side. The mechanical component includes a forward overhanging portion and an aft overhanging portion. The forward overhanging portion is disposed at a leading edge of the airfoil, extending longitudinally beyond the leading edge, and proximate to the inlet recess portion. The aft overhanging portion is disposed at a trailing edge of the airfoil and extends longitudinally beyond the trailing edge, where both the forward and aft overhanging portions further extend circumferentially along the pressure side and the suction side of the airfoil. The aft overhanging portion includes a non-axisymmetric profile for regulating ingress of a fluid along a circumferential direction from the pressure side to the suction side, at the trailing edge.

In accordance with yet another embodiment, a method for regulating a circumferential ingress of a fluid in a turbomachine is disclosed. In accordance with aspects of the disclosed technique, the method includes directing the fluid along a stationary component and a rotatable component of the turbomachine. The rotatable component is disposed within the stationary component, where the rotatable component includes an airfoil and a mechanical component coupled to the airfoil. The airfoil includes a pressure side and a suction side. The mechanical component includes a forward overhanging portion and an aft overhanging portion. The forward overhanging portion is disposed at a leading edge of the airfoil and extends longitudinally beyond the leading edge. The aft overhanging portion is disposed at a trailing edge of the airfoil and extends longitudinally beyond the trailing edge, where both the forward and aft overhanging portions further extend circumferentially along the pressure side and the suction side of the airfoil. The method further includes rotating the rotatable component along a circumferential direction of the rotatable component. Further, the method includes regulating the ingress of the fluid at the trailing edge along the circumferential direction from the pressure side to the suction side via the aft overhanging portion including a non-axisymmetric profile.

DRAWINGS

These and other features and aspects of embodiments of the present invention will become better understood when the following detailed description is read with reference to the accompanying drawings in which like characters represent like parts throughout the drawings, wherein.

DETAILED DESCRIPTION

Figure 1:
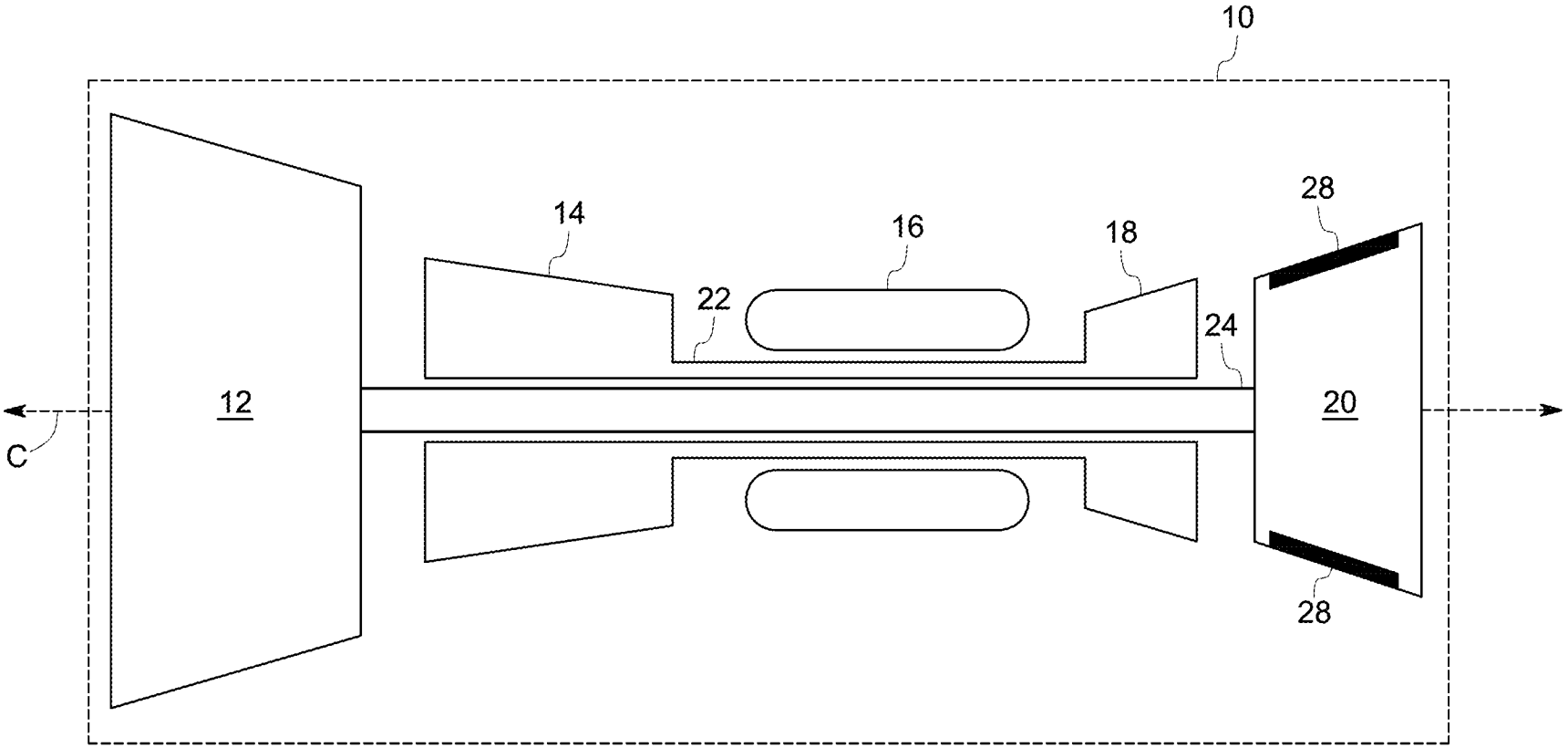
FIG. 1 is a schematic diagram of a turbomachine, for example, a gas turbine engine, in accordance with aspects of the disclosed technique.

Embodiments discussed herein disclose a rotatable component for a turbomachine, such as a turbine or a compressor. The rotatable component is disposed within a stationary component of the turbomachine. The rotatable component includes an airfoil and a mechanical component that is coupled to the airfoil. The mechanical component is configured to regulate a periodic ingress of fluid, for example, a working fluid at a trailing edge from a pressure side to a suction side of the airfoil. In certain embodiments, the working fluid may include at least one of combustion gases or a compressed fluid. In some embodiments, the mechanical component is coupled to a tip of the airfoil and defines a tip shroud cavity between the stationary component and the mechanical component. In such an example embodiment, the mechanical component is a shroud. In some other embodiments, the mechanical component is coupled to a root of the airfoil and defines a root platform cavity between the mechanical component and a shank of the rotatable component. In such an example embodiment, the mechanical component is a platform. In one or more embodiments, the mechanical component includes a forward overhanging portion and an aft overhanging portion. The forward overhanging portion is disposed at a leading edge of the airfoil and extends longitudinally beyond the leading edge. The aft overhanging portion is disposed at a trailing edge of the airfoil and extends longitudinally beyond the trailing edge. In certain embodiments, both the forward overhanging portion and the aft overhanging portion further extend circumferentially along a pressure side and a suction side of the airfoil. In certain embodiments, the aft overhanging portion includes a non-axisymmetric profile for regulating ingress of the working fluid along a circumferential direction from the pressure side to the suction side, at the trailing edge of the airfoil. In one or more embodiments, the aft overhanging portion extended along the pressure side is bent at a first angle relative to a longitudinal axis "C" (i.e., an axial direction "A" of the turbomachine) of the rotatable component and the aft overhanging portion extended along the suction side is bent at a second angle different from the first angle, relative to the longitudinal axis "C." It should be noted herein that the first angle and the second angle may provide the non-axisymmetric profile to the aft overhanging portion.

In some embodiments, the first angle is in a range from −2 degrees to −20 degrees and the second angle is in a range from 2 degrees to 20 degrees. In such an example embodiment, the aft overhanging portion may reduce mixing of the working fluid with a leakage fluid flow in the tip shroud cavity or the root platform cavity, by decreasing a flow area extending along the pressure side of the aft overhanging portion and increasing the flow area extending along the suction side of the aft overhanging portion. Thus, the aft overhanging portion may control the undesirable pressure losses in the airfoil by regulating the circumferential ingress of the working fluid at the trailing edge of the airfoil. Controlling the undesirable pressure losses in the airfoil enhances aerodynamic performance of the turbomachine.

In some other embodiments, the first angle is in a range from 2 degrees to 20 degrees and the second angle is in a range from −2 degrees to −20 degrees. In such an example embodiment, the aft overhanging portion may increase mixing of the working fluid with the leakage fluid flow in the tip shroud cavity or the root platform cavity, by increasing a flow area extending along the pressure side of the aft overhanging portion and decreasing a flow area extending along the suction side of the aft overhanging portion. Thus, the aft overhanging portion may control the undesirable pressure losses in a downstream stator nozzle of the turbomachine, by regulating the circumferential ingress of the working fluid at the trailing edge of the airfoil. Controlling the undesirable pressure losses in the downstream stator nozzle enhances the aerodynamic performance of the turbomachine.

In certain embodiments, the mechanical component, for example, the shroud includes a forward seal portion disposed proximate to the forward overhanging portion facing a forward abradable seal portion of abradable seal portions of the stationary component, and between the aft overhanging portion and the forward overhanging portion. The shroud further includes an aft seal portion disposed proximate to the aft overhanging portion facing an aft abradable seal portion of the abradable seal portions, and between the forward seal portion and the aft overhanging portion. In such an example embodiment, the shroud is further configured to regulate the leakage fluid flow in the tip shroud cavity along the axial direction, "A" using an inlet recess portion and the abradable seal portions, and the aft overhanging portion, the forward seal portion, and the aft seal portion.

FIG. 1 illustrates a schematic diagram of a turbomachine, such as a gas turbine engine 10 in accordance with one example embodiment of the disclosed technique. The gas turbine engine 10 includes a fan 12, a compressor 14, a combustor 16, a high-pressure turbine 18, and a low-pressure turbine 20, arranged in a serial and an axial flow relationship along a longitudinal axis "C" extending in an axial direction "A" of the gas turbine engine 10. The compressor 14 may be a multistage compressor and the high-pressure and low-pressure turbines 18, 20 may be a multistage turbine. The compressor 14 and the high-pressure turbine 18 are coupled to the combustor 16. The low-pressure turbine 20 is disposed downstream relative to the high-pressure turbine 18. The compressor 14, the combustor 16, and the high-pressure turbine 18 may be collectively referred to as a core engine of the gas turbine engine 10.

During operation, the fan 12 is configured to receive fluid such as air and generate a pressurized fluid. A portion of the pressurized fluid may be fed to an inlet of the compressor 14 and a remaining portion of the pressurized fluid may bypass the core engine to provide thrust to the gas turbine engine 10. The compressor 14 is configured to receive the portion of the pressurized fluid from the fan 12 and compress the pressurized fluid to generate a compressed fluid. The combustor 16 is configured to receive the compressed fluid from the compressor 14 and a fuel such as natural gas from a plurality of fuel injectors (not shown) and burn the fuel and the compressed fluid within a combustion zone (not shown) to generate combustion gases. The high-pressure turbine 18 is configured to receive the combustion gases from the combustor 16 and expand the combustion gases to convert energy of the combustion gases to work. The high-pressure turbine 18 is configured to drive the compressor 14 through an outer shaft 22. The low-pressure turbine 20 is configured to receive expanded combustion gases from the high-pressure turbine 18 to convert remaining energy of the expanded combustion gases to work. The low-pressure turbine 20 is configured to drive the fan 12 through an inner shaft 24.

In one embodiment, at least some components of the gas turbine engine 10, such as the compressor 14, the high-pressure turbine 18, and the low-pressure turbine 20 may include a rotatable component, for example, a rotor (not shown) and a mechanical component (not shown). For example, the mechanical component may include at least one of a shroud or a platform, where each of the shroud and the platform may have a non-axisymmetric profiled an aft overhanging portion. For example, in the illustrated embodiment, the low-pressure turbine 20 includes the rotatable component including an airfoil and a mechanical component 28, such as the shroud coupled to a tip of the airfoil. In such example embodiments, the mechanical component 28 may include an aft overhanging portion having a non-axisymmetric profile. Such a mechanical component 28 is discussed in greater details below with reference to subsequent figures.

While the illustrated gas turbine engine 10 is a high-bypass turbofan engine, the principles described herein may be equally applicable to turboprop, turbojet, and turbo shaft engines, as well as other types of engines used for other vehicles or stationary applications. Furthermore, while the low-pressure turbine 20 is used as an example, it will be understood that the embodiments of the present disclosure may be applied to any turbine, including without limitation to the high-pressure turbine 18, other intermediate-pressure turbines (not shown), and the compressor 14.

Figure 2:
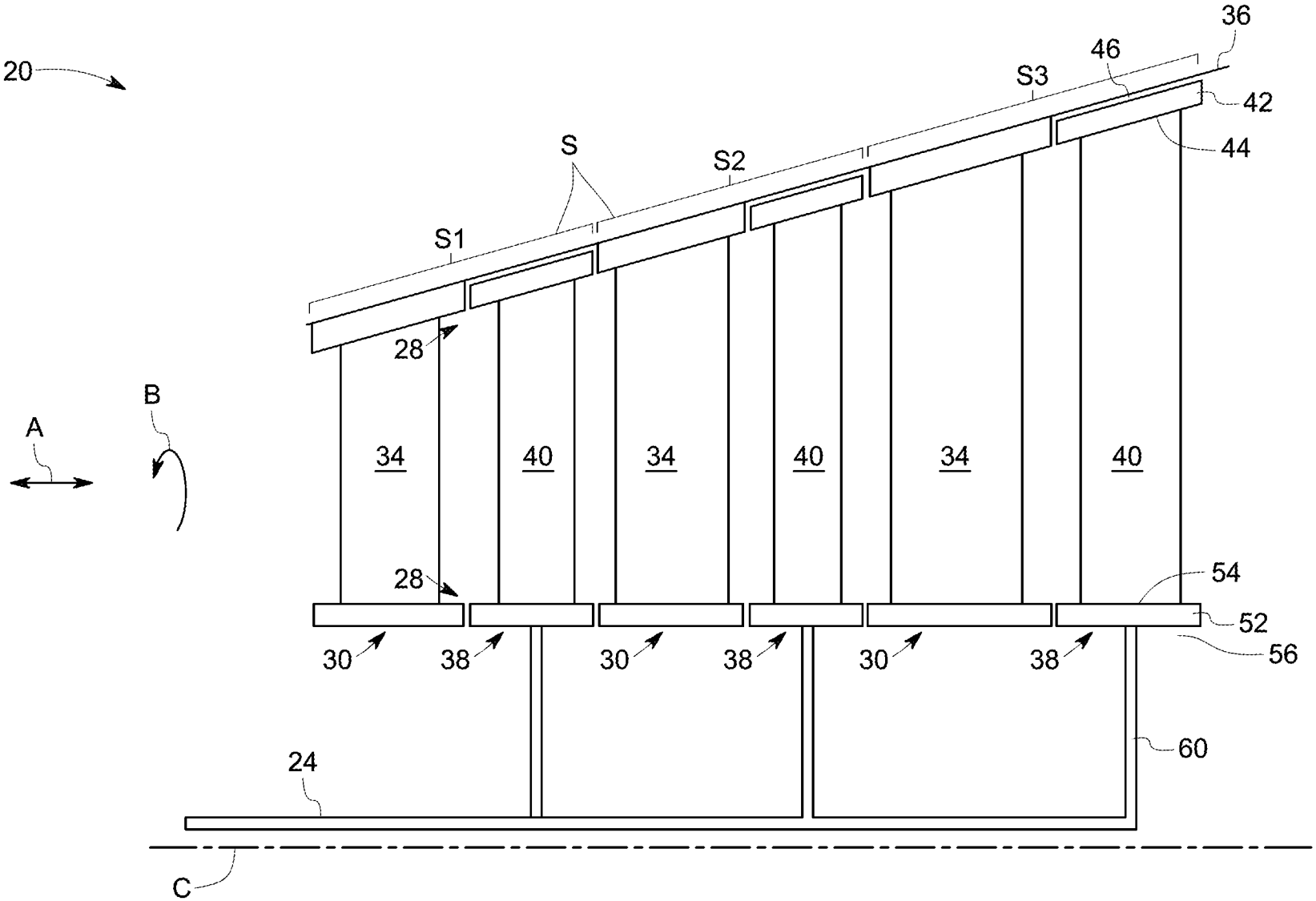
FIG. 2 is a schematic diagram of a low-pressure turbine of a gas turbine engine, in accordance with aspects of the disclosed technique.

FIG. 2 illustrates a schematic diagram of a low-pressure turbine 20 of a gas turbine engine 10 in accordance with one exemplary embodiment of the disclosed technique. In the illustrated embodiment, the low-pressure turbine 20 includes stages "S" represented specifically by a first-stage "$S_1$," a second-stage "$S_2$," and a third-stage "$S_3$." Each of the stages "S" includes a nozzle 30 and a rotatable component 38 (i.e. a rotor). The nozzle 30 includes an annular array of stator blades 34, where each of the annular array of stator blades 34 is disposed along a circumferential direction "B" of the low-pressure turbine 20. It should be noted herein that only one stator blade 34 in each of the stages "S" is shown in FIG. 2 for the ease of illustration. Each of the stator blades 34 is coupled to a stationary component 36 (i.e. a casing) of the low-pressure turbine 20. The rotatable component 38 includes an annular array of airfoils 40 (i.e. rotor blades), where each airfoil of the annular array of airfoils 40 is disposed along the circumferential direction "B" of the low-pressure turbine 20. It should be noted herein that only one airfoil of the array of airfoils 40 in each of the stages "S" is shown in FIG. 2 for the ease of illustration. The rotatable component 38 further includes mechanical components 28, for example, at least one of a shroud 42 or a platform 52. The shroud 42 is coupled to a tip 44 of each airfoil of the annular array of airfoils 40 and the platform 52 is coupled to a root 54 of each airfoil of the annular array of airfoils 40. In the illustrated embodiment, the annular array of airfoils 40 is further coupled to the inner shaft 24 via a shank 60 coupled to the platform 52. In certain embodiments, the shank 60 may include a dovetail arrangement (not shown) for coupling the annular array of the airfoils 40 to the inner shaft 24. In some embodiments, the annular array of airfoils 40 of each of the stages "S" are all co-rotating and coupled to the inner shaft 24.

In some embodiments, the rotatable component 38 is disposed within the stationary component 36 to define a tip shroud cavity 46 between the mechanical component 28 and the stationary component 36. In the illustrated embodiment, the tip shroud cavity 46 is defined between the shroud 42 and a portion of the stationary component 36 in each of the stages "S." Similarly, the platform 52 is coupled to the root 54 such that a root platform cavity 56 is defined between the platform 52 and the shank 60 in each of the stages "S." The shroud 42 and the platform 52 are discussed in greater detail below with reference to subsequent figures.

Figure 3:
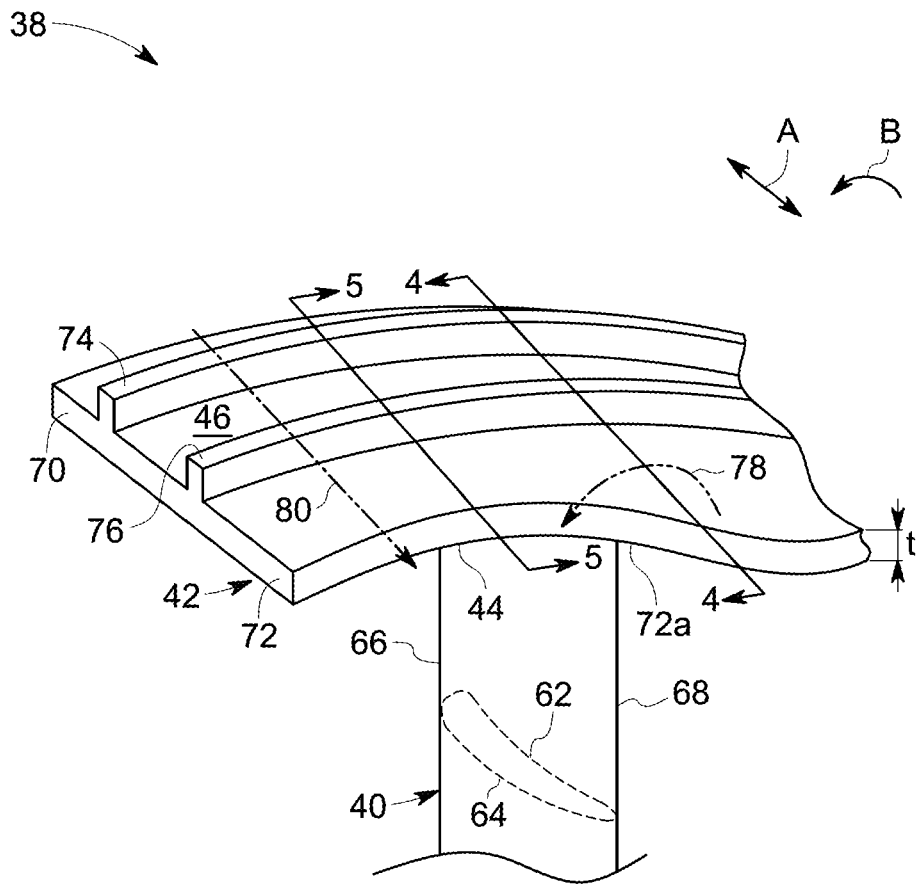
FIG. 3 is a perspective view of a portion of a rotatable component, in accordance with aspects of the disclosed technique.

FIG. 3 illustrates a perspective view of a portion of rotatable component 38 in accordance with one exemplary embodiment of the disclosed technique. In the illustrated embodiment of FIG. 3, the portion of the rotatable component 38 includes an airfoil 40 and a mechanical component, for example, a shroud 42. It should be noted herein that only one airfoil 40 among an annular array of airfoils is shown in the embodiment of FIG. 3 and such an illustration should not be construed as a limitation of the present disclosure. In one embodiment, the airfoil 40 includes a pressure side 62, a suction side 64, a leading edge 66, and a trailing edge 68. The shroud 42 is coupled to a tip 44 of the airfoil 40. The shroud 42 has a uniform thickness "T." In one or more embodiments, the shroud 42 is an annular component coupled to the tip 44 of each airfoil 40 of the annular array of airfoils. In one or more embodiments, the rotatable component 38 is configured to be disposed within a stationary component 36 (as shown in FIG. 2) to define a tip shroud cavity 46 between the shroud 42 and the stationary component 36.

In one embodiment, the shroud 42 includes a forward overhanging portion 70, an aft overhanging portion 72, a forward seal portion 74, and an aft seal portion 76. The forward overhanging portion 70 is disposed at the leading edge 66 of the airfoil 40 and extends longitudinally beyond the trailing edge along the axial direction "A." The aft overhanging portion 72 is disposed at the trailing edge 68 of the airfoil 40 and extends longitudinally beyond the trailing edge 68 along the axial direction "A." In certain embodiments, both the forward overhanging portion 70 and the aft overhanging portion 72 further extend circumferentially along the pressure side 62 and the suction side 64 of the airfoil 40 along the circumferential direction "B." In one embodiment, the forward overhanging portion 70 has a symmetric profile and the aft overhanging portion 72 has a non-axisymmetric profile. In the illustrated embodiment of FIG. 3, the forward overhanging portion 70 has a flat profile and the aft over hanging portion 72 has a S-shaped profile. For example, a portion 72*a* of the aft overhanging portion 72 extending along the pressure side 62 is bent at a first angle (not labeled) relative to the longitudinal axis "C" extending along the axial direction "A" and another portion 72*b* of the aft overhanging portion 72 extending along the suction side 64 is bent at a second angle (not labeled) relative to the longitudinal axis "C." In some embodiments, the second angle is different from the first angle. In such example embodiments, the first and second angles provide the non-axisymmetric profile to the aft overhanging portion 72. In one embodiment, the forward seal portion 74 is disposed proximate to the forward overhanging portion 70 and between the aft overhanging portion 72 and the forward overhanging portion 70. The aft seal portion 76 is disposed proximate to the aft overhanging portion 72 and between the forward seal portion 74 and the aft overhanging portion 72.

During operation of the turbomachine, a fluid, for example, a working fluid 78 is directed from an outlet of the high-pressure turbine 18 (as shown in FIG. 2) to an inlet of the low-pressure turbine 20. Specifically, the working fluid is directed along the stationary component 36 (as shown in FIG. 2) and the rotatable component 38 of the low-pressure turbine 20 (as shown in FIG. 2). In some embodiments, the working fluid 78 is combustion gases. In some other embodiments, the working fluid 78 may be compressed fluid. The working fluid 78 causes rotating of the rotatable component 38 along the circumferential direction "B." In such embodiments, a portion of the combustion gases leaks towards a downstream stator blade 34 (as shown in FIG. 3) through the tip shroud cavity 46, bypassing the airfoil 40. In such embodiments, the portion of the combustion gases may be referred to as a leakage fluid flow 80, which flows along the axial direction "A" of the turbomachine. In such an example embodiment, the forward and aft seal portions 74, 76 are used for regulating the leakage fluid flow 80 along the tip shroud cavity 46. Specifically, the forward and aft seal portions 74, 76 along with the stationary component 36 is configured to define a tortuous flow path along the tip shroud cavity 46 for the leakage fluid flow 80, to regulate the leakage of the working fluid 78 in the axial direction "A." Further, in some embodiments, pressure difference between the suction side 64 and the pressure side 62 of the airfoil 40 causes a periodic ingress of the working fluid 78 in the circumferential direction "B" at the trailing edge 68 of the airfoil 40 from the pressure side 62 to the suction side 64 via the tip shroud cavity 46. Such a periodic ingress of the working fluid 78 may result in mixing of the working fluid 78 with the leakage fluid flow 80 at the trailing edge 68, thus causing undesirable pressure losses, and affecting aerodynamic performance of the airfoil 40. In such example embodiments, the aft overhanging portion 72 having the non-axisymmetric profile is configured to regulate the periodic ingress of the working fluid 78 along the circumferential direction "B," thereby managing the undesirable pressure losses and the aerodynamic performance of the airfoil 40. The method of regulating the leakage fluid flow 80 and the circumferential ingress of the working fluid 78 are discussed in greater details below.

Figure 4:
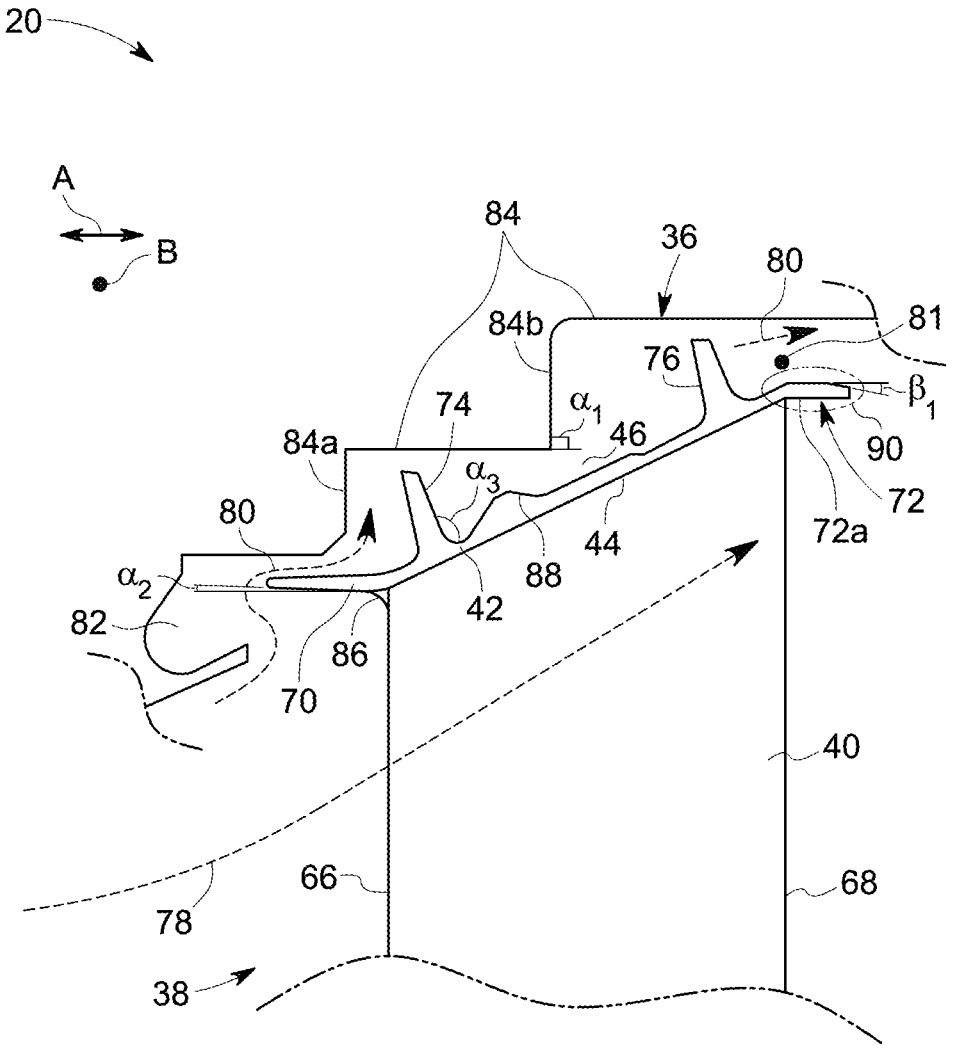
FIG. 4 is a sectional view of a portion of the rotatable component taken along line 4-4 in FIG. 3 and a stationary component of a turbomachine, in accordance with aspects of the disclosed technique.

FIG. 4 illustrates a sectional view of a portion of the rotatable component 38 taken along line 4-4 in FIG. 3 and a stationary component 36 of a turbomachine, such as a low-pressure turbine 20 in accordance with one example embodiment of the disclosed technique. It should be noted herein that the section view taken along the line 4-4 in FIG. 3, represents the aft overhanging portion 72 viewed from the pressure side 62 of the airfoil 40.

In one embodiment, the stationary component 36 includes an inlet recess portion 82 and abradable seal portions 84. In some embodiments, the inlet recess portion 82 is located upstream relative to a flow of a working fluid 78 and the abradable seal portions 84 are disposed downstream to the inlet recess portion 82. In one embodiment, the abradable seal portions 84 includes a forward abradable seal portion 84*a* and an aft abradable seal portion 84*b* located downstream to the forward abradable seal portion 84*a* relative to the flow of the working fluid 78. In one embodiment, each of the forward and aft abradable seal portions 84*a*, 84*b* may be made of a honeycomb component having a plurality of honeycomb cells. In certain other embodiments, each of the forward and aft abradable seal portions 84*a*, 84*b* may be made of a porous component. In one or more embodiments, the forward and aft abradable seal portions 84*a*, 84*b* may be brazed to an inner surface (not shown) of the stationary component 36. In one embodiment, the surface may be a stepped surface. In some other embodiments, the surface may be a flat surface. In one embodiment, each of the forward and aft abradable seal portions 84*a*, 84*b* is inclined at an angle "$\alpha_1$38 relative to a longitudinal axis "C" of the low-pressure turbine 20. In some embodiments, the angle "$\alpha_1$" is in a range from 80 degrees to 100 degrees.

In one embodiment, the rotatable component 38 includes an airfoil 40 and a shroud 42. In some embodiments, the shroud 42 is coupled to a tip 44 of the airfoil 40 using a casing fillet 86. In some embodiments, the rotatable component 38 is disposed within the stationary component 36 to define a tip shroud cavity 46 between the shroud 42 and the stationary component 36. In certain embodiments, the shroud 42 includes a forward overhanging portion 70, a forward seal portion 74, an aft seal portion 76, and an aft overhanging portion 72.

The forward overhanging portion 70 is disposed at a leading edge 66 of the airfoil 40, extending longitudinally beyond the leading edge 66, and proximate to the inlet recess portion 82. In the illustrated embodiment, the forward overhanging portion 70 is aligned at an angle "$\alpha_2$" relative to the longitudinal axis "C" and faces the inlet recess portion 82. In some embodiments, the angle "$\alpha_2$" is about 0 degree. The aft overhanging portion 72 is disposed at a trailing edge 68 of the airfoil 40 and extends longitudinally beyond the trailing edge 68. As discussed in the embodiment of FIG. 3, both the forward overhanging portion 70 and the aft overhanging portion 72 further extend circumferentially along the pressure side 62 and the suction side 64 of the airfoil 40. A portion 72*a* of the aft overhanging portion 72 extending along the pressure side 62 is bent downwardly and away from the stationary component 36 at a first angle "$\beta_1$" relative to the longitudinal axis "C." In one embodiment, the first angle "$\beta_1$" is in a range from −2 degrees to −20 degrees.

The forward seal portion 74 is disposed proximate to the forward overhanging portion 70 facing the forward abradable seal portion 84*a*. In the example embodiment, the forward overhanging portion 70 is disposed between the aft overhanging portion 72 and the forward overhanging portion 70. The aft seal portion 76 is disposed proximate to the aft overhanging portion 72 facing the aft abradable seal portion 84*b* and between the forward seal portion 74 and the aft overhanging portion 72. In some embodiments, each of the forward seal portion 74 and the aft seal portion 76 is inclined at an angle "$\alpha_3$" relative to the longitudinal axis "C." In some embodiments, the angle "$\alpha_3$" is in a range from 110 degrees to 140 degrees. In the illustrated embodiment, the shroud 42 further includes a corrugated seal portion 88 extending between the forward seal portion 74 and the aft seal portion 76. The corrugated seal portion 88 faces a portion of the forward and aft abradable seal portions 84*a*, 84*b*.

During operation, the working fluid 78 is directed along the rotatable component 38 causing the airfoil 40 to rotate along a circumferential direction "B." In such an embodiment, a portion of the working fluid 78 may leak along the longitudinal axis "C" from the leading edge 66 to the trailing edge 68 through the tip shroud cavity 46 without contributing to extraction of the work. The portion of the working fluid 78 is referred to as a leakage fluid flow 80. In such embodiments, the forward overhanging portion 70, the forward seal portion 74, the corrugated seal portion 88, the aft seal portion 76, the inlet recess portion 82, the forward abradable seal portion 84*a*, and the aft abradable seal portion 84*b* are configured to regulate the leakage fluid flow 80 through the tip shroud cavity 46. In one embodiment, regulating the leakage fluid flow 80 involves recirculating a first portion of the leakage fluid flow 80 within the inlet recess portion 82 by deflecting the portion of the leakage fluid flow 80, using the forward overhanging portion 70. The regulating step further includes recirculating a second portion of the leakage fluid flow 80 within a first region formed between the forward seal portion 74 and the forward abradable seal portion 84*a*. Further, the regulation step includes recirculating a third portion of the leakage fluid flow 80 within a second region formed between the corrugated seal portion 88 and the forward and aft abradable seal portions

84*a*, 84*b*. The regulation step further includes recirculating a fourth portion of the leakage fluid flow 80 within a third region formed between the aft seal portion 76 and the aft abradable seal portion 84*b*. As a result, the shroud 42 and the portion of the stationary component 36 defines a tortuous flow path for the leakage fluid flow 80 to flow along the tip shroud cavity 46, thereby reducing leakage of the working fluid 78 through the tip shroud cavity 46 and increasing quantity of the working fluid 78 available for work extraction by the airfoil 40 leading to improvement in aerodynamic performance of the low-pressure turbine 20.

In some embodiments, the forward and aft abradable seal portions 82*a*, 82*b* may additionally provide a diffusion effect to the leakage fluid flow 80 to reduce the amount of the leakage fluid flow 80 flowing through the tip shroud cavity 46. Further, during certain transient operating conditions of the low-pressure turbine 20, the forward seal portion 74 and the aft seal portion 76 may contact certain portions of the forward abradable seal portion 84*a* and the aft abradable seal portion 84*b* respectively, thereby damaging the forward and aft abradable seal portions 82*a*, 82*b*. The damaged forward and aft abradable seal portions 82*a*, 82*b* may be easily removed from the surface of the stationary component 36 and replaced with suitable abradable portions.

Further, the pressure difference at the trailing edge 68 of the airfoil 40, between the pressure side 62 and the suction side 64 causes another portion of the working fluid 78 to ingress along a circumferential direction "B" via the tip shroud cavity 46. The other portion of the working fluid 78 is referred to as an ingress flow 81. In one embodiment, the portion 72*a* of the aft overhanging portion 72 is configured to regulate the ingress flow 81 of the working fluid 78 along the circumferential direction "B" from the pressure side 62 to the suction side 64, at the trailing edge 68. Thus, decreasing the undesirable pressure losses, and improving the aerodynamic performance of the airfoil 40. The steps of regulating the ingress flow 81 along the circumferential direction "B" are discussed in greater details below.

Figure 5:
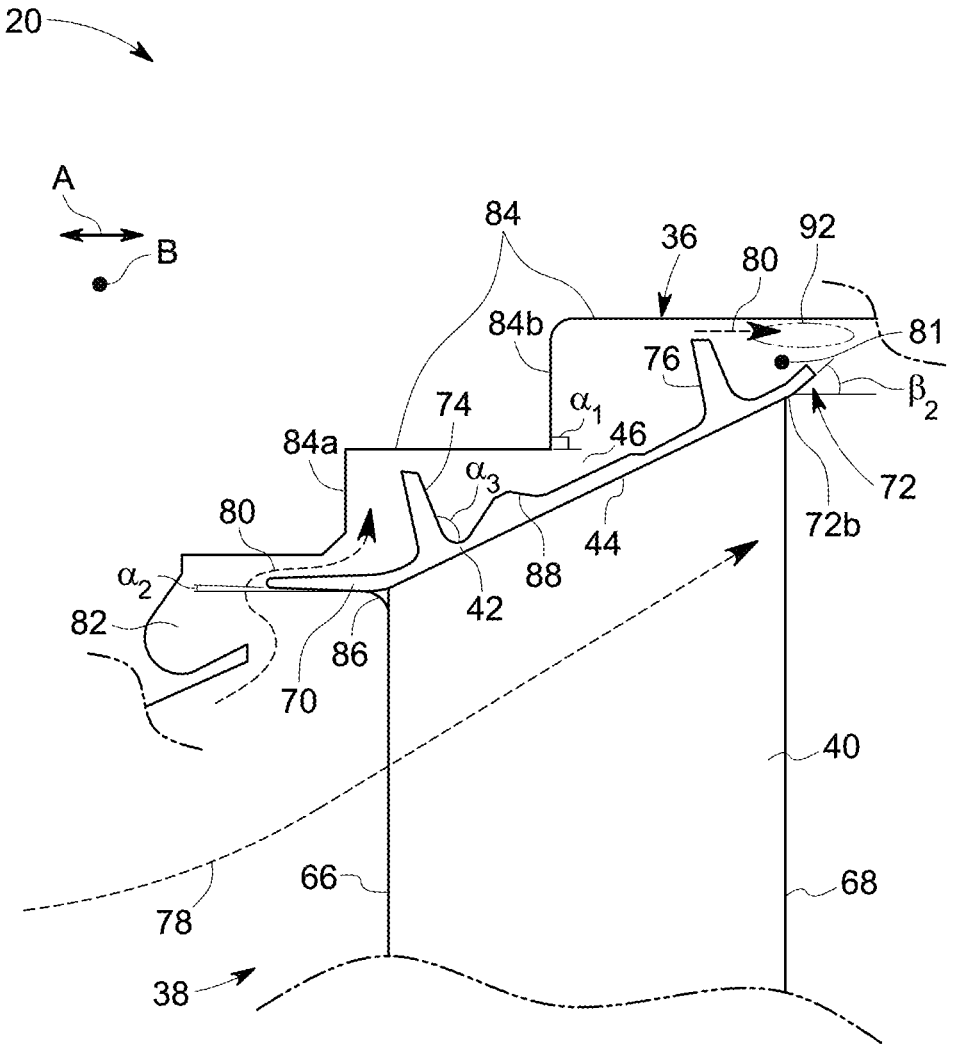
FIG. 5 is a sectional view of another portion of the rotatable component taken along line 5-5 in FIG. 3 and a stationary component of a turbomachine, in accordance with aspects of the disclosed technique.

FIG. 5 illustrates a sectional view of another portion of the rotatable component 38 taken along line 5-5 in FIG. 3 and a stationary component 36 of the low-pressure turbine 20 in accordance with one example embodiment of the disclosed technique. It should be noted herein that the section view taken along the line 5-5 in FIG. 3, represents the aft overhanging portion 72 viewed from the suction side 64 of the airfoil 40.

The embodiment of FIG. 5 is substantially similar to the embodiment of FIG. 4, except that another portion 72*a* of the aft overhanging portion 72 extending along the suction side 64 is bent upwardly and towards the stationary component 36 at a second angle "$\beta_2$" relative to the longitudinal axis "C." In one embodiment, the first angle "$\beta_1$" is different from the second angle "$\beta_2$." In some embodiments, the second angle "$\beta_2$" is in a range from 2 degrees to 20 degrees.

Referring again to FIGS. 4 and 5, the portion 72*a* and the other portion 72*b* of the aft overhanging portion 72 collectively provides a non-axisymmetric profile, for example, a S-shaped profile for the aft overhanging portion 72. In such embodiments, the aft overhanging portion 72 having the non-axisymmetric profile is configured to regulate the ingress flow 81 of the working fluid 78 along the circumferential direction "B" from the pressure side 62 to the suction side 64, at the trailing edge 68. During operation, the ingress flow 81 may get mixed with the leakage fluid flow 80 at the trailing edge 68 of the airfoil 40, thereby resulting undesired pressure losses, and affecting the aerodynamic performance of the airfoil 40. In such example embodiments, the aft overhanging portion 72 regulates the ingress flow 81 by decreasing a flow area 90 (as shown in FIG. 4) extending along the pressure side 62 of the aft overhanging portion 72 and increasing the flow area 92 (as shown in FIG. 4) extending along the suction side 64 of the aft overhanging portion 72. Thus, the aft overhanging portion 72 reduces mixing of the ingress flow 81 with the leakage fluid flow 80, thereby decreasing the undesirable pressure losses in the airfoil 40. In particular, reducing the mixing of the leakage fluid flow 80 with the ingress flow 81, using the aft overhanging portion 72 having the non-axisymmetric profile improves the aerodynamic performance of the airfoil 40.

Although not illustrated, in some other embodiments, a portion 72*a* of the aft overhanging portion 72 extending along the pressure side 62 may be bent upwardly and towards the stationary component 36 at a first angle "$\beta_1$" relative to a longitudinal axis "C" of the low-pressure turbine 20. Similarly, another portion 72*b* of the aft overhanging portion 72 extending along the suction side 64 may be bent downwardly and away from the stationary component 36 at a second angle "$\beta_2$" relative to the longitudinal axis "C." In such example embodiments, the first angle "$\beta_1$" may be different from the second angle "$\beta_2$." In such embodiments, the first angle "$\beta_1$" may be in a range from 2 degrees to 20 degrees and the second angle "$\beta_2$" may be in a range from −2 degrees to −20 degrees.

In such example embodiments, the portion 72*a* and the other portion 72*b* of the aft overhanging portion 72 collectively provides a non-axisymmetric profile for the aft overhanging portion 72. During operation of the turbomachine, the aft overhanging portion 72 may regulate the ingress flow 81 by increasing a flow area (not shown) extending along the pressure side 62 of the aft overhanging portion 72 and decreasing the flow area (not shown) extending along the suction side 64 of the aft overhanging portion 72. Thus, the aft overhanging portion 72 may increase mixing of the ingress flow 81 with the leakage fluid flow 80, thereby decreasing the undesirable pressure losses in a downstream stator blade. In particular, increasing the mixing of the leakage fluid flow 80 with the ingress flow 81, using the aft overhanging portion 72 having the non-axisymmetric profile may improve the aerodynamic performance of the downstream stator blade.

Figure 6:
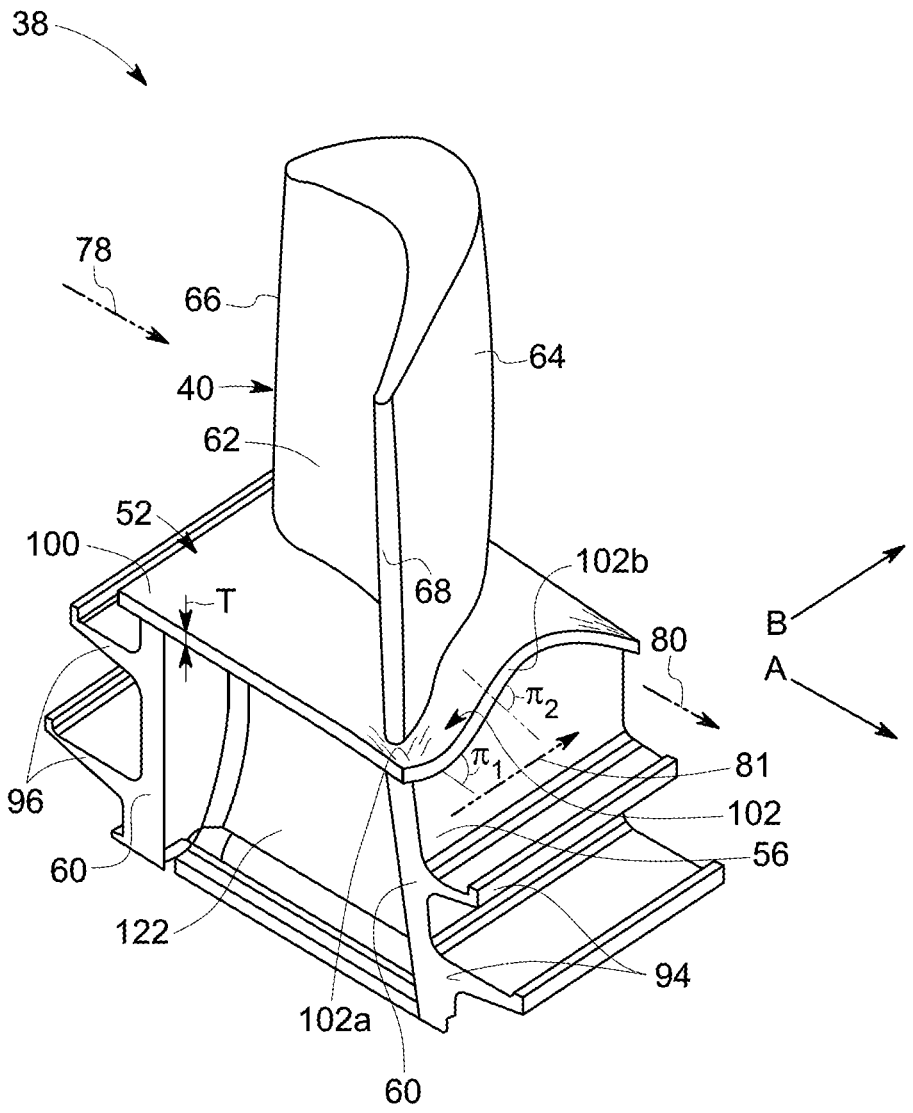
FIG. 6 is a perspective view of a portion of a rotatable component, in accordance with aspects of the disclosed technique.

FIG. 6 illustrates a perspective view of a portion of rotatable component 38 in accordance with one example embodiment of the disclosed technique. The portion of the rotatable component 38 includes an airfoil 40 and a mechanical component, for example, a platform 52. It should be noted herein that only one airfoil 40 among an annular array of airfoils is shown in the embodiment of FIG. 6 and such an illustration should not be construed as a limitation of the present disclosure. In one embodiment, the airfoil 40 includes a pressure side 62, a suction side 64, a leading edge 66, and a trailing edge 68. The platform 52 is coupled to a root 54 of the airfoil 40. The platform 52 has a uniform thickness "T." In one or more embodiments, the platform 52 is an annular component coupled to the root 54 of each airfoil 40 of the annular array of airfoils. In certain embodiments, the airfoil 40 is further coupled to the inner shaft of the rotatable component 38 via a shank 60, which is coupled to the platform 52. In some embodiments, the shank 60 may include a dovetail arrangement (not shown) for coupling the airfoil 40 to the inner shaft. In the illustrated embodiment, the platform 52 is coupled to the root 54 such that a root platform cavity 56 is defined between the platform 52 and the shank 60. In the illustrated embodiment, the rotatable component 38 further includes angle wings 94, 96 coupled to either peripheral end portions of the shank 60.

In one embodiment, the platform 52 includes a forward overhanging portion 100 and an aft overhanging portion 102. The forward overhanging portion 100 is disposed at the leading edge 66 of the airfoil 40 and extends longitudinally along an axial direction "A" beyond the leading edge 66. The aft overhanging portion 102 is disposed at the trailing edge 68 of the airfoil 40 and extends longitudinally beyond the trailing edge 68. In certain embodiments, both the forward overhanging portion 100 and the aft overhanging portion 102 further extend circumferentially along the pressure side 62 and the suction side 64 of the airfoil 40 along a circumferential direction "B." In one embodiment, the forward overhanging portion 100 has a symmetric profile and the aft overhanging portion 102 has a non-axisymmetric profile. In the illustrated embodiment of FIG. 6, the forward overhanging portion 100 has a flat profile and the aft over hanging portion 102 has a S-shaped profile. For example, a portion 102*a* of the aft overhanging portion 102 extending along the pressure side 62 is bent downwards and towards the shank 60 at a first angle "$\pi_1$" relative to the longitudinal axis "C" extending along the axial direction "A" and another portion 102*b* of the aft overhanging portion 102 extending along the suction side 64 is bent upwardly away from the shank 60 at a second angle "$\pi_2$" relative to the longitudinal axis "C.' In some embodiments, the second angle "$\pi_2$" is different from the first angle "$\pi_1$." In the illustrated embodiment, the first angle "$\pi_1$" is in a range from −2 degrees to −20 degrees and the second angle "$\pi_2$" is in a range from 2 degrees to 20 degrees. In such example embodiments, the first and second angles "$\pi_1$," "$\eta_2$" provide the non-axisymmetric profile to the aft overhanging portion 102.

As discussed in the embodiment of FIGS. 4 and 5, the aft overhanging portion 102 having the non-axisymmetric profile is configured to regulate an ingress flow 81 of a working fluid 78 along the circumferential direction "B" from the pressure side 62 to the suction side 64, at the trailing edge 68. During operation, the ingress flow 81 may get mixed with the leakage fluid flow 80 at the root 54 of the trailing edge 68, thereby resulting undesired pressure losses, and affecting the aerodynamic performance of the airfoil 40. In such example embodiments, the aft overhanging portion 102 regulates the ingress flow 81 by decreasing a flow area (not labeled in FIG. 6) extending along the pressure side 62 of the aft overhanging portion 102 and increasing the flow area (not labeled in FIG. 6) extending along the suction side 64 of the aft overhanging portion 102. Thus, the aft overhanging portion 102 reduces mixing of the ingress flow 81 with the leakage fluid flow 80, thereby decreasing the undesirable pressure losses in the airfoil 40. In other words, reducing the mixing of the leakage fluid flow 80 with the ingress flow 81, using the aft overhanging portion 102 having the non-axisymmetric profile improves the aerodynamic performance of the airfoil 40.

Although not illustrated, in some other embodiments, a portion 102*a* of the aft overhanging portion 102 extending along the pressure side 62 may be bent upwardly and away from the shank 60 at a first angle "$\pi_1$38 relative to the longitudinal axis "C." Similarly, another portion 102*b* of the aft overhanging portion 102 extending along the suction side 64 may be bent downwardly and towards the shank 60 at a second angle "$\pi_2$" relative to the longitudinal axis "C." In such example embodiments, the first angle "$\pi_1$" may be different from the second angle "$\pi_2$." In such embodiments, the first angle "$\pi_1$" may be in a range from 2 degrees to 20 degrees and the second angle "$\beta_2$" may be in a range from −2 degrees to −20 degrees.

In such example embodiments, the portion 102*a* and the other portion 102*b* of the aft overhanging portion 102 collectively provides a non-axisymmetric profile for the aft overhanging portion 102. During operation of the turbomachine, the aft overhanging portion 102 may regulate the ingress flow 81 by increasing a flow area (not shown) extending along the pressure side 62 of the aft overhanging portion 102 and decreasing the flow area (not shown) extending along the suction side 64 of the aft overhanging portion 102. Thus, the aft overhanging portion 102 may increase mixing of the ingress flow 81 with the leakage fluid flow 80, thereby decreasing the undesirable pressure losses in a downstream stator blade. In other words, increasing the mixing of the leakage fluid flow 80 with the ingress flow 81, using the aft overhanging portion 102 having the non-axisymmetric profile may improve the aerodynamic performance of the downstream stator blade.

In one non-limiting embodiment of the present invention, the mechanical component 28 of the rotatable component 38 as discussed in the embodiments of FIGS. 1-6 facilitates to improve the aerodynamic performance of the gas turbine engine 10 up to 0.20 percent compared to a conventional mechanical system. In one non-limiting embodiment of the present invention, the system having a tip shroud cavity discussed with reference to the embodiments of FIGS. 1-6 may be disposed between a tip of each stator blade and the rotatable component to control leaking of a fluid and also to improve an aerodynamic efficiency of the turbomachine.

In accordance with one or more embodiments discussed herein, an example aft overhanging portion is configured to regulate an ingress of a working fluid along a circumferential direction via a tip shroud cavity or a root platform cavity, at a trailing edge from a pressure side to a suction side of an airfoil. Thus, the example aft overhanging portion is configured to regulate mixing losses of the leakage fluid flow with the working fluid so manage the aerodynamic performance of the airfoil or a downstream stator blade. The abradable seal portions disposed on a surface of the stationary component reduce the risk of damaging the rotatable component during transient operating conditions or during displacement caused due to thermal expansion between the rotatable component and the stationary component. Further, the sealing components of the shroud and the stationary component as discussed in one or more embodiments herein reduces the leakage fluid flow along an axial direction in a tip shroud cavity.

While only certain features of embodiments have been illustrated and described herein, many modifications and changes will occur to those skilled in the art. It is, therefore, to be understood that the appended embodiments are intended to cover all such modifications and changes as falling within the spirit of the invention.

What is claimed is:

1. A turbomachine, defining an axial centerline defining a longitudinal axis, the turbomachine comprising:

a stationary component defined as a casing of the turbomachine and comprising an inlet recess portion, wherein the inlet recess portion converges radially inward toward the longitudinal axis to an apex; and a rotatable component rotatable about the longitudinal axis, the rotatable component comprising:

an airfoil comprising a pressure side and a suction side; and a mechanical component coupled to the airfoil, wherein the mechanical component comprises:

a forward overhanging portion disposed at a leading edge of the airfoil and extending longitudinally beyond the leading edge; and an aft overhanging portion disposed at a trailing edge of the airfoil and extending longitudinally beyond the trailing edge, wherein both the forward overhanging portion and the aft overhanging portion further extend circumferentially along the pressure side and the suction side of the airfoil, and wherein the aft overhanging portion comprises a non-axisymmetric profile for regulating ingress of a fluid along a circumferential direction from the pressure side to the suction side, at the trailing edge.

2. The turbomachine of claim 1, wherein the mechanical component is a shroud coupled to a tip of the airfoil.

3. The turbomachine of claim 1, wherein the mechanical component is a platform coupled to a root of the airfoil.

4. The turbomachine of claim 1, wherein the aft overhanging portion extending along the pressure side is bent at a first angle relative to the longitudinal axis of the rotatable component, and wherein the aft overhanging portion extending along the suction side is bent at a second angle different from the first angle, relative to the longitudinal axis, and wherein the first angle and the second angle provide the non-axisymmetric profile to the aft overhanging portion.

5. The turbomachine of claim 4, wherein the first angle is in a range from −2 degrees to −20 degrees, and wherein the second angle is in a range from 2 degrees to 20 degrees.

6. The turbomachine of claim 4, wherein the first angle is in a range from 2 degrees to 20 degrees, and wherein the second angle is in a range from −2 degrees to −20 degrees.

7. A turbomachine, defining an axial centerline defining a longitudinal axis, the turbomachine comprising:

a stationary component defined as a casing of the turbomachine and comprising an inlet recess portion and abradable seal portions; and a rotatable component disposed within the stationary component, wherein the rotatable component comprises an airfoil comprising a pressure side and a suction side, and a mechanical component coupled to the airfoil, wherein the mechanical component comprises:

a forward overhanging portion disposed at a leading edge of the airfoil, extending longitudinally beyond the leading edge, and proximate to the inlet recess portion;

wherein the inlet recess portion converges radially inward towards the longitudinal axis of the turbomachine to an apex;

an aft overhanging portion disposed at a trailing edge of the airfoil and extending longitudinally beyond the trailing edge, wherein both the forward overhanging portion and the aft overhanging portion further extend circumferentially along the pressure side and the suction side of the airfoil, and wherein the aft overhanging portion comprises a non-axisymmetric profile for regulating ingress of a fluid along a circumferential direction from the pressure side to the suction side, at the trailing edge.

8. The turbomachine of claim 7 is at least one of compressor and aturbine.

9. The turbomachine of claim 7, wherein the mechanical component is a shroud, wherein the shroud is coupled to a tip of the airfoil to define a tip shroud cavity between the shroud and the stationary component.

10. The turbomachine of claim 7, wherein the mechanical component is a platform, wherein the platform is coupled to a root of the airfoil to define a root platform cavity between the platform and a shroud of the rotatable component.

11. The turbomachine of claim 7, wherein the aft overhanging portion extending along the pressure side is bent downwardly and away from the stationary component at a first angle relative to a longitudinal axis of the rotatable component, wherein the aft overhanging portion extending along the suction side is bent upwardly and towards the stationary component at a second angle relative to the longitudinal axis.

12. The turbomachine of claim 11, wherein the first angle is in a range from −2 degrees to −20 degrees, and wherein the second angle is in a range from 2 degrees to 20 degrees.

13. The turbomachine of claim 7, wherein the aft overhanging portion extending along the pressure side is bent upwardly and towards the stationary component at a first angle relative to a longitudinal axis of the rotatable component, wherein the aft overhanging portion extending along the suction side is bent downwardly and away from the stationary component at a second angle relative to the longitudinal axis.

14. The turbomachine of claim 13, wherein the first angle is in a range from 2 degrees to 20 degrees, and wherein the second angle is in a range from −2 degrees to −20 degrees.

15. The turbomachine of claim 7, wherein the mechanical component further comprises a forward seal portion disposed proximate to the forward overhanging portion facing a forward abradable seal portion of the abradable seal portions and between the aft overhanging portion and the forward overhanging portion, and wherein the mechanical component further comprises an aft seal portion disposed proximate to the aft overhanging portion facing an aft abradable seal portion of the abradable seal portions and between the forward seal portion and the aft overhanging portion.

16. A method comprising:

directing a fluid along a stationary component defined as a casing and a rotatable component of a turbomachine, wherein the rotatable component is disposed within the stationary component comprising an inlet recess portion converging radially toward a longitudinal axis of the turbomachine to an apex, wherein the rotatable component comprises an airfoil comprising a pressure side and a suction side, and a mechanical component coupled to the airfoil; wherein the mechanical component comprises:

recirculating the fluid within the inlet recess portion upstream a forward overhanging portion disposed at a leading edge of the airfoil and extending parallel with or radially outward from a longitudinal axis of the turbomachine and longitudinally beyond the leading edge;

directing the fluid along the forward overhanging portion;

directing the fluid along an aft overhanging portion disposed at a trailing edge of the airfoil and extending longitudinally beyond the trailing edge, wherein both the forward overhanging portion and the aft overhanging portion further extend circumferentially along the pressure side and the suction side of the airfoil;

rotating the rotatable component along a circumferential direction of the rotatable component;

regulating an ingress of the fluid at the trailing edge along the circumferential direction from the pressure side to the suction side via the aft overhanging portion comprising a non-axisymmetric profile.

17. The method of claim 16, wherein regulating the ingress of the fluid comprises reducing mixing of the fluid with a leakage fluid flow in a cavity, by decreasing a first flow area extending along the pressure side of the aft overhanging portion and increasing a second flow area extending along the suction side of the aft overhanging portion, the component further comprises an aft seal portion disposed proximate to the aft overhanging portion facing an aft abradable seal portion of the abradable seal portions and between a forward seal portion and the aft overhanging portion.

18. The method of claim 17, wherein the first flow area extending along the pressure side is decreased by bending the aft overhanging portion downwardly and away from the stationary component at a first angle relative to the longitudinal axis of the rotatable component, the second flow area extending along the suction side is increased by bending the aft overhanging portion upwardly and towards the stationary component at a second angle relative to the longitudinal axis, the first angle is in a range from −2 degrees to −20 degrees, and the second angle is in a range from 2 degrees to 20 degrees.

19. The method of claim 16, wherein regulating the ingress of the fluid comprises increasing mixing of the fluid with a leakage fluid flow in a cavity, by increasing a first flow area extending along the pressure side of the aft overhanging portion and decreasing a second flow area extending along the suction side of the aft overhanging portion, the mechanical component is one of a shroud or a platform and the cavity is a tip shroud cavity defined between the shroud and the stationary component or a root platform cavity defined between the platform and a shank of the rotatable component.

20. The method of claim 19, wherein the first flow area extending along the pressure side is increased by bending the aft overhanging portion upwardly and towards the stationary component at a first angle relative to the longitudinal axis of the rotatable component, the second flow area extending along the suction side is decreased by bending the aft overhanging portion downwardly and away from the stationary component at a second angle relative to the longitudinal axis, the first angle is in a range from 2 degrees to 20 degrees, and the second angle is in a range from −2 degrees to −20 degrees.

* * * * *